US009605921B2

(12) United States Patent
Pysarenko

(10) Patent No.: US 9,605,921 B2
(45) Date of Patent: Mar. 28, 2017

(54) PERCUSSION FIRING MECHANISM OF THE PISTOL

(71) Applicant: Viktor Pysarenko, Vinnitsya (UA)

(72) Inventor: Viktor Pysarenko, Vinnitsya (UA)

( * ) Notice: Subject to any disclaimer, the term of this patent is extended or adjusted under 35 U.S.C. 154(b) by 0 days.

(21) Appl. No.: 14/913,993

(22) PCT Filed: Jan. 24, 2014

(86) PCT No.: PCT/UA2014/000009
§ 371 (c)(1),
(2) Date: Feb. 23, 2016

(87) PCT Pub. No.: WO2015/030694
PCT Pub. Date: Mar. 5, 2015

(65) Prior Publication Data

US 2016/0202011 A1 Jul. 14, 2016

(30) Foreign Application Priority Data

Aug. 27, 2013 (UA) ..... 201310458

(51) Int. Cl.
*F41A 19/30* (2006.01)
*F41A 9/65* (2006.01)
(Continued)

(52) U.S. Cl.
CPC ..... *F41A 19/30* (2013.01); *F41A 9/65* (2013.01); *F41A 17/72* (2013.01); *F41A 19/10* (2013.01); *F41A 19/13* (2013.01); *F41A 19/14* (2013.01)

(58) Field of Classification Search
USPC ..... 42/69.01, 69.02, 16, 17, 18, 20, 22
See application file for complete search history.

(56) References Cited

U.S. PATENT DOCUMENTS 3,890,729 A * 6/1975 Frisoli ..... F41A 9/41 42/18
5,741,996 A * 4/1998 Ruger ..... F41A 3/66 42/16

(Continued)

FOREIGN PATENT DOCUMENTS

| | | |
|---|---|---|
| EP | 1566606 | 8/2005 |
| WO | WO 03/081160 | 10/2003 |
| WO | WO 2010/065977 | 6/2010 |

*Primary Examiner* — J. Woodow Eldred
(74) *Attorney, Agent, or Firm* — Weiner & Burt, P.C.; Irving M. Weiner; Pamela S. Burt

(57) ABSTRACT

Invention refers to the armament industry, namely to percussion firing mechanism of the pistol and according to the invention, the barrel is moving inside the frame parallel to the slide axis only, at that the cartridge is located in the magazine in alignment with the barrel, the hammer is performed with firing pin located in the slide lateral channel and has the ledge directed upwards to interact with the hammer spring and the ledge, directed downwards to interact with pistol trigger mechanism, at the rear part of the slide, under the hammer the port is performed, which contains the hammer spring module, located in case, which is fixed at the front part of the slide port by means of catches and by means of the cross pin at the rear part and contains the tube-form extractor with collar for the interaction with hammer ledge, at that the front end of the guide is inserted in extractor lateral hole, but its rear end intrudes in the hole, performed at the guiding socket base, the hammer spring, located inside the guiding socket between the guiding socket base and extractor collar, grips the guide and extractor and the ends of the guide are inserted into the module case walls holes, therewith the firing mechanism contains the automatic safety device, ledge of which, driven by the safety device spring intrudes into the hammer notch, providing its lengthwise displacement inability. The invention allows improving (Continued)

Figure 1:
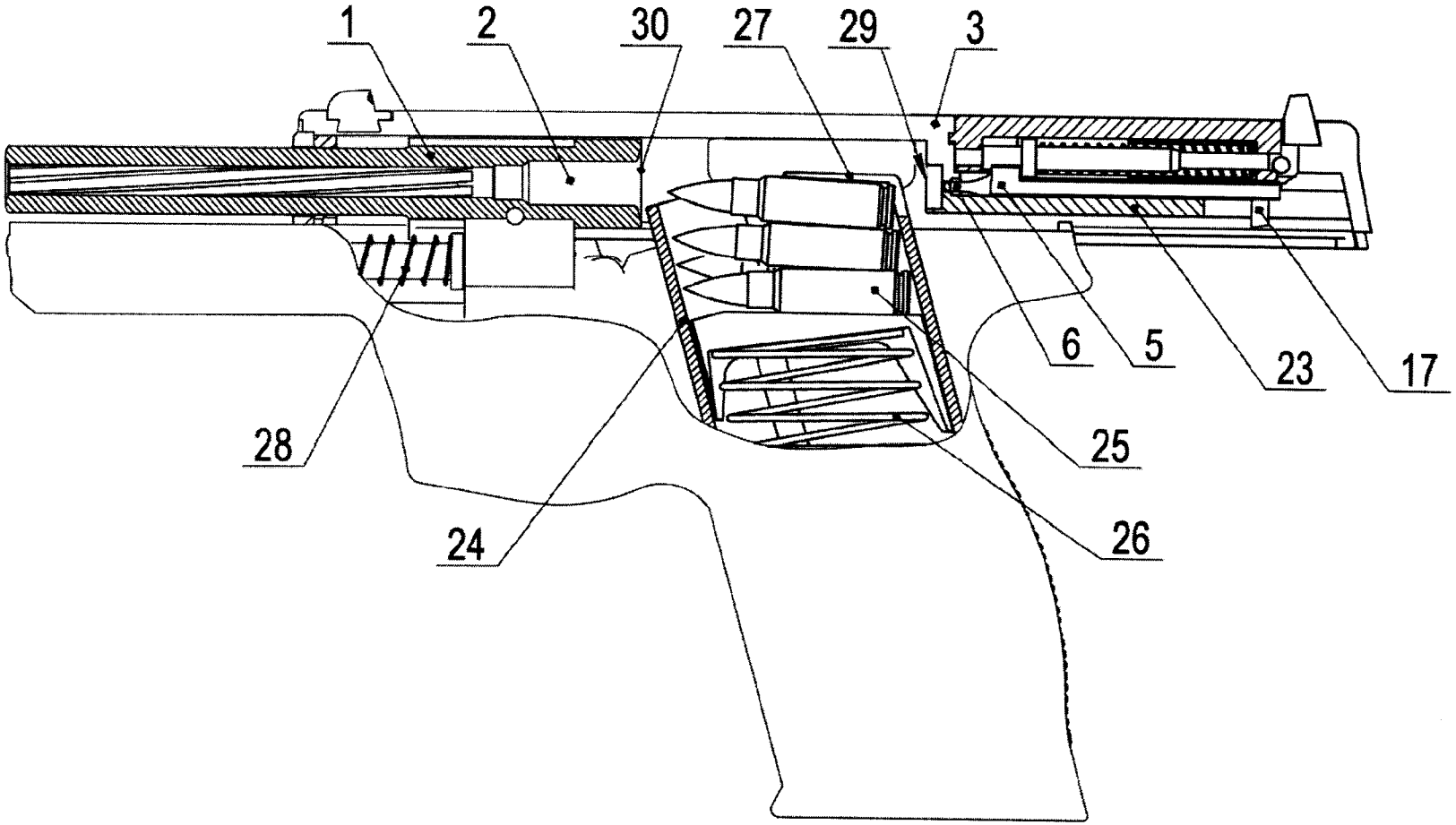

the pistol operation durability due to the cartridge jamming against the barrel breech face possibility elimination, and to ensure maintenance, disassembly, cleaning ease due to the firing mechanism components, located in the quick-release module of the slide.

8 Claims, 3 Drawing Sheets

(51) Int. Cl.

| | |
|---|---|
| ***F41A 19/10*** | (2006.01) |
| ***F41A 19/14*** | (2006.01) |
| ***F41A 17/72*** | (2006.01) |
| ***F41A 19/13*** | (2006.01) |

(56) References Cited

U.S. PATENT DOCUMENTS

| | | | | |
|---|---|---|---|---|
| 7,340,987 | B1 * | 3/2008 | Williams | F41A 3/64 42/15 |
| 8,234,807 | B2 * | 8/2012 | LaTorre | F41A 9/38 42/16 |
| 2003/0183069 | A1 | 10/2003 | Bubits | |
| 2006/0048428 | A1 | 3/2006 | Thomele et al. | |
| 2013/0000173 | A1 | 1/2013 | Green | |

* cited by examiner

PERCUSSION FIRING MECHANISM OF THE PISTOL

Invention refers to the armament industry, namely to percussion firing mechanism of the pistol, which transfers the impact energy to the firing pin, located in the slide and moving simultaneously with the slide.

Most similar analog of the enounced invention is "GLOCK 17" pistol firing mechanism (electronic internet-encyclopedia "Wikipedia"; gunmagazine.com "GLOCK 17").

Known pistol percussion firing mechanism consists of barrel with cartridge chamber, which during the cartridge delivery from the magazine, located under the barrel axis, has a beveled buildup in breech, bevel is performed with oval angularity, therewith the barrel breech is moving over the vertical plane downwards during the cartridge delivery.

The main problem of such firing mechanism is that during the delivery of the cartridge, located in magazine under the barrel axis, in the cartridge chamber, the cartridge jams against the breech end of the barrel (cartridge jamming). Therewith, it is impossible to extract the firing pin without special tool during the pistol maintenance. Such action requires the extraction of both split tension bushings which hold the module and can be executed only at factory or workshop conditions.

At the hart of invention is the goal to create percussion firing mechanism of the pistol, wherein the cartridge jamming possibility will be completely excluded and to assure the access ease to the cartridge chamber and firing mechanism components during the operation and maintenance by means of the firing mechanism design change and new elements implementation, which should improve the pistol operation durability and firing mechanism maintenance ease.

Set task solution is ensured that the pistol percussion firing mechanism containing barrel, performed with cartridge chamber, at that the barrel is moving inside the frame with the breech cross motion over the vertical plain downwards to provide the cartridge supply, located in the magazine under the barrel axis in cartridge chamber, the slide at the rear part of which located the firing mechanism module, fixed by two split tension bushings and consists of the hammer with firing pin; hammer spring, located under the hammer, which grips the guide, at that the front end of the guide is intrudes into the hollow, performed on the hammer ledge, and the hammer spring bears against the guide collar at one end while the other end is rest against the rear inner wall of the module, according to the invention, the barrel is moving inside the frame parallel to the slide axis only, at that the cartridge is located in the magazine in alignment with the barrel, the hammer is performed with firing pin located in the slide lateral channel and has the ledge directed upwards to interact with the hammer spring and the ledge, directed downwards to interact with pistol trigger mechanism; at the rear part of the slide, under the hammer, the port is performed, which contains the hammer spring module, located in case, which is fixed at the front part of the slide port by means of catches and by means of the cross pin at the rear part, contains the tube-form extractor with collar for the interaction with hammer ledge, at that the front end of the guide is inserted in extractor lateral hole, but its rear end intrudes in the hole, performed at the guiding socket base, the hammer spring, located inside the guiding socket between the guiding socket base and extractor collar and grips the guide and extractor and the ends of the guide are inserted into the module case walls holes, therewith the firing mechanism contains the automatic safety device, ledge of which, driven by the safety device spring, intrudes into the hammer notch, providing its lengthwise displacement inability.

Namely these properties are necessary and sufficient for the set task solution.

The fact that the cartridge chamber is located in line with the cartridge, which is supplied from the magazine, provides the reliability improvement during the shooting by means of the cartridge jamming against the breech face possibility elimination.

The fact that the hammer performed with the firing pin, located in the lateral slide channel and extracts from the slide after the hammer spring module extraction, located in the opened top slide port and fixed by the pin, provides the access ease to the hammer and firing mechanism components during the maintenance and hammer or hammer spring replacement necessity.

The invention essence is shown on figures:

FIG. 1 the mechanism of the cartridge supply from the magazine into the cartridge chamber longitudinal section (slide in rearmost position).

Figure 2:
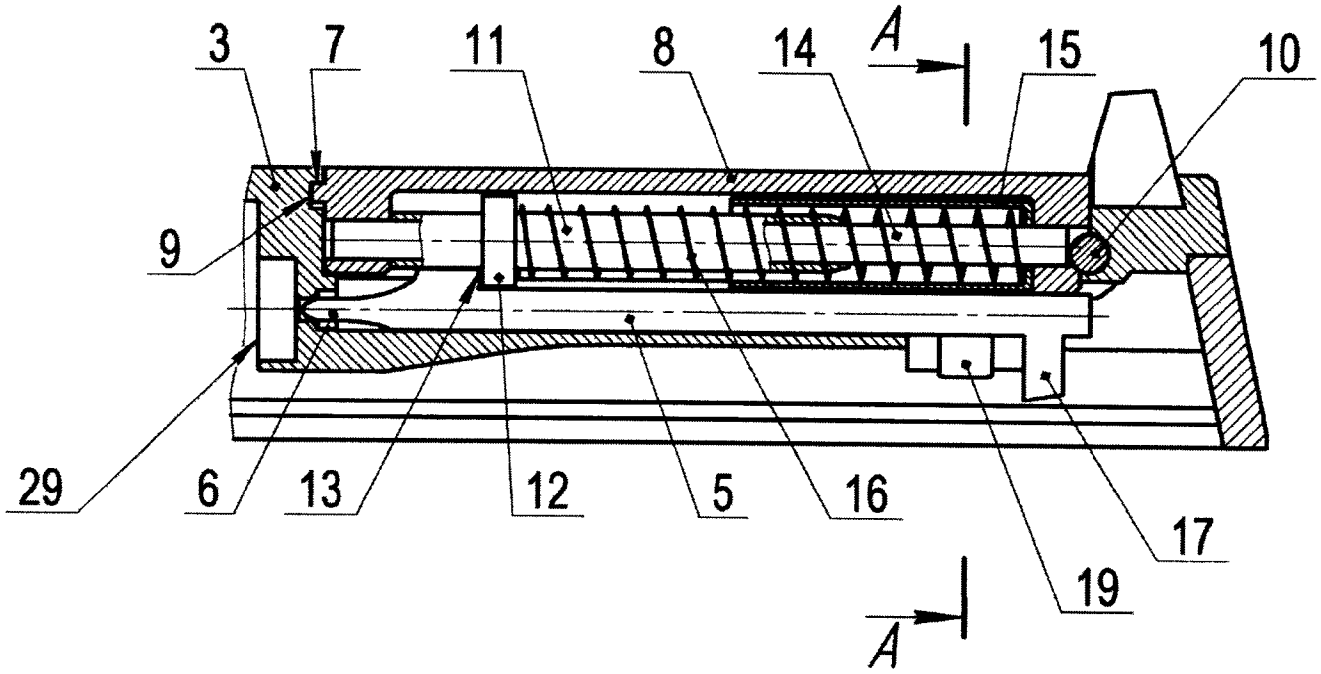

FIG. 2 slide rear part longitudinal section (the slide is in forward position).

Figure 3:
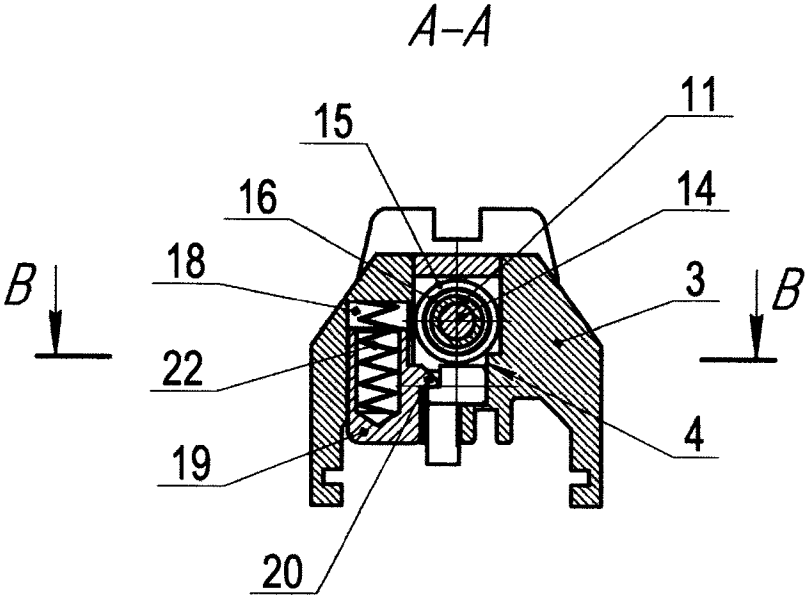

FIG. 3 slide cross section by A-A on FIG. 2.

Figure 4:
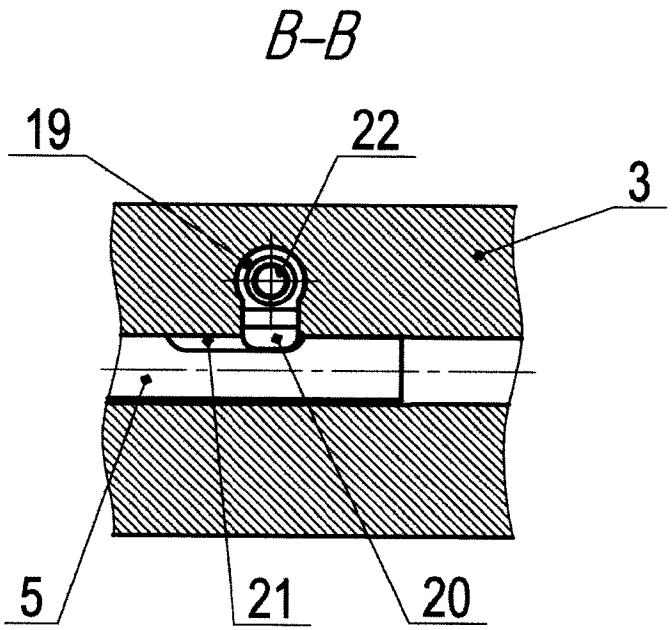

FIG. 4 slide longitudinal section by B-B on FIG. 3

Percussion firing mechanism consists of the barrel 1 with cartridge chamber 2, slide 3, hammer 5, located in longitudinal slot 4 of the slide 3, performed with the firing pin 6 and front ledge 13, directed upwards for the interaction with hammer spring 16 and ledge 17, directed downwards for the interaction with the trigger mechanism, case 8 of the hammer 5 spring 16 module, located in the opened top rectangular port 7, performed in the rear part of the slide 3 under the hammer 5, at that the case 8 is fixed at the front side of the port 7 by means of catches 9 and at the rear side it is fixed by the cross pin 10. Tube-form extractor 11, performed with collar step 12, located behind the hammer 5 ledge 13; guide 14, front part of which is inserted in lateral hole of the extractor 11 and rear part intrudes into the hole, performed in guiding socket 15 base at that the ends of the guide 14 are inserted in the holes in case 8 side walls and fixed by the slide 3 port 7 walls; hammer 5 spring 16, located in guiding socket 15, grips the extractor 11 and guide 14 and bears in front against the extractor 11 collar step 12 and from behind against the guiding socket 15 base, pressed against the rear wall of the case 8 are located in the case 8.

Automatic safety device, placed into the closed vertical hole 18, performed in the slide 3 consists of the plunger 19, performed as the cylindrical socket with ledge 20, which intrudes into slot 21, performed in hammer 5 and automatic safety device spring 22, which bears against the plunger 19 base at one end and in the slide 3 hole 18 base at other end, providing the hammer 5 lock when the automatic safety device is on the "block" position.

Percussion Firing Mechanism Operation During the Loading and Shooting

Pistol loading is executed by the slide 3 retraction backwards home with following release, during the slide 3 backward motion, the recoil spring 28 compresses, slide 3 bar 23 moves beyond the back wall of the magazine 24 and allows the cartridge 25 under the influence of the magazine spring 26 to nestle up to the magazine 24 lips 27. Under the slide 3 release, the recoil spring 28 relaxes and slide 3 is moving forward, by breeching face 29 pushes the cartridge 25, located under the magazine 24 lips 27 into the cartridge chamber 2. Considering that the cartridge chamber 2 axis and cartridge 25 axis, located under the magazine 24 lips 27 are approximately coincide, the possibility of the cartridge 25 jamming against the breech end 30 of the barrel 1 is completely eliminated.

Pistol shot is executed by the trigger pull, at that one trigger mechanism arm strokes the plunger 19 of the automatic safety device, brings out the plunger 19 ledge 20 from the hammer 5 slot 21 and releases the hammer 5, simultaneously, the second trigger mechanism arm affecting on the hammer 5 ledge 17, forces the hammer 5 to move back, at that the hammer 5 ledge 13 strokes on the collar step 12 of the extractor 11, which on his way backwards along the guide 14, compresses the hammer 5 spring 16. When the second arm of the trigger mechanism occurs lower than ledge 17, hammer 5 releases and under the action of the preliminary compressed spring 16 by the firing pin 6 hits the primer of the cartridge 25, located in the cartridge chamber 2. The shot is done.

The described invention allows improving the pistol operation durability due to the cartridge jamming against the barrel breech face possibility elimination, and to ensure maintenance, disassembly, cleaning ease due to the firing mechanism components, located in the quick-release module of the slide.

The invention claimed is:

1. A percussion firing mechanism for a pistol, comprising, in combination:

a pistol frame;

a pistol barrel moveably disposed within said frame;

a recoil spring;

said pistol barrel is provided with a cartridge chamber and a breech end;

a slide member having a longitudinal slot therein, an opened top rectangular port, and an enclosed vertical hole;

said slide member including a slide bar having a breeching face member;

a hammer disposed in said longitudinal slot;

said hammer being provided with a firing pin, a front ledge, and a rear ledge;

a case structure provided with a hammer spring therewithin and affixation catch members, said case structure having a front side thereof fixed to said slide member by way of said affixation catch members, and having a rear side thereof fixed to said slide member by a cross pin;

a cartridge magazine including a magazine spring, a plurality of cartridges, and magazine lips;

pistol loading is executed by retraction backwards of said slide member whereupon said recoil spring compresses, said slide bar moves beyond a back wall of said cartridge magazine allowing one of said plurality of cartridges under the influence of said magazine spring to contact said magazine lips;

upon release of said slide member, said recoil spring relaxes and said slide member moves forwardly with said breeching face member pushing the cartridge contacting said magazine lips into said cartridge chamber; and said cartridge chamber having a central elongated axis which approximately coincides with a central elongated axis of the cartridge contacting said magazine lips, thus eliminating the possibility of the cartridge jamming against said breech end of said barrel.

2. The mechanism of claim 1, including:

said hammer being provided with a hammer slot therein;

an automatic safety device placed into said enclosed vertical hole of said slide member;

said automatic safety device comprising an automatic safety device spring which bears against a plunger having a plunger ledge which protrudes into said hammer slot; and said automatic safety device providing a lock of said hammer when said automatic safety device is in a block position.

3. The mechanism of claim 1, including:

a tube-form extractor having lateral hole and a collar step located behind said hammer front ledge; and a guide having a front portion thereof inserted in said lateral hole of said extractor, and having a rear portion thereof inserted in a hole of a guiding socket base.

4. The mechanism of claim 2, including:

a tube-form extractor having lateral hole and a collar step located behind said hammer front ledge; and a guide having a front portion thereof inserted in said lateral hole of said extractor, and having a rear portion thereof inserted in a hole of a guiding socket base.

5. The mechanism of claim 1, including:

a trigger mechanism having a trigger, a first trigger mechanism arm, and a second trigger mechanism arm; and wherein a pistol shot is executed by a pull of said trigger whereby said first trigger mechanism arm strokes a plunger of an automatic safety device which brings said plunger ledge out of a hammer slot and releases said hammer;

and simultaneously said second trigger mechanism arm contacts said hammer rear ledge forcing said hammer to move backwardly causing said hammer front ledge to stroke a collar step of an extractor which moves backwardly along a guide to compress said hammer spring; and when said second trigger mechanism arm moves lower than said hammer rear ledge, said hammer releases and under pressure from the preliminary compressed hammer spring causes said firing pin to hit the cartridge located in said cartridge chamber.

6. The mechanism of claim 2, including:

a trigger mechanism having a trigger, a first trigger mechanism arm, and a second trigger mechanism arm; and wherein a pistol shot is executed by a pull of said trigger whereby said first trigger mechanism arm strokes said plunger of said automatic safety device which brings said plunger ledge out of said hammer slot and releases said hammer;

and simultaneously said second trigger mechanism arm contacts said hammer rear ledge forcing said hammer to move backwardly causing said hammer front ledge to stroke a collar step of an extractor which moves backwardly along a guide to compress said hammer spring; and when said second trigger mechanism arm moves lower than said hammer rear ledge, said hammer releases and under pressure from the preliminary compressed hammer spring causes said firing pin to hit the cartridge located in said cartridge chamber.

7. The mechanism of claim 3, including:

a trigger mechanism having a trigger, a first trigger mechanism arm, and a second trigger mechanism arm; and wherein a pistol shot is executed by a pull of said trigger whereby said first trigger mechanism arm strokes a plunger of an automatic safety device which brings said plunger ledge out of a hammer slot and releases said hammer;

and simultaneously said second trigger mechanism arm contacts said hammer rear ledge forcing said hammer to move backwardly causing said hammer front ledge to stroke said collar step of said extractor which moves backwardly along said guide to compress said hammer spring; and when said second trigger mechanism arm moves lower than said hammer rear ledge, said hammer releases and under pressure from the preliminary compressed hammer spring causes said firing pin to hit the cartridge located in said cartridge chamber.

8. The mechanism of claim 4, including:

a trigger mechanism having a trigger, a first trigger mechanism arm, and a second trigger mechanism arm; and wherein a pistol shot is executed by a pull of said trigger whereby said first trigger mechanism arm strokes said plunger of said automatic safety device which brings said plunger ledge out of said hammer slot and releases said hammer;

and simultaneously said second trigger mechanism arm contacts said hammer rear ledge forcing said hammer to move backwardly causing said hammer front ledge to stroke said collar step of said extractor which moves backwardly along said guide to compress said hammer spring; and when said second trigger mechanism arm moves lower than said hammer rear ledge, said hammer releases and under pressure from the preliminary compressed hammer spring causes said firing pin to hit the cartridge located in said cartridge chamber.

* * * * *